US005691273A

United States Patent [19]

Slark et al.

[11] Patent Number: 5,691,273

[45] Date of Patent: Nov. 25, 1997

[54] THERMAL TRANSFER PRINTING DYE SHEET

[75] Inventors: Andrew Trevithick Slark; Richard Anthony Hann, both of Ipswich, United Kingdom

[73] Assignee: Imperial Chemical Industries PLC, London, England

[21] Appl. No.: 624,439

[22] PCT Filed: Oct. 5, 1994

[86] PCT No.: PCT/GB94/02166

§ 371 Date: Jul. 16, 1996

§ 102(e) Date: Jul. 16, 1996

[87] PCT Pub. No.: WO95/09732

PCT Pub. Date: Apr. 13, 1995

[30] Foreign Application Priority Data

Oct. 6, 1993 [GB] United Kingdom ..... 9320592

[51] Int. Cl.[6] ..... B41M 5/035; B41M 5/38

[52] U.S. Cl. ..... 503/227; 356/138; 427/146; 428/195; 428/913; 428/914

[58] Field of Search ..... 8/471; 428/195, 428/913, 914; 503/227; 427/146; 356/138

[56] References Cited

U.S. PATENT DOCUMENTS 5,240,900 8/1993 Burberry ..... 503/227

*Primary Examiner*—Bruce H. Hess

[57] ABSTRACT

A dye sheet for thermal transfer printing comprising a substrate having on one surface thereof a dye coat which comprises a dye capable of thermal transfer dispersed in a polymer binder, characterized in that R−1 is a minimum where $R=K_{sl}/K_{tt}$, wherein $K_{sl}=AD_{sl}/AP_{sl}$ where $AD_{sl}$ is the absorption due to the dye and $AP_{sl}$ is the absorption due to the polymer over the surface layer;

$K_{tt}=AD_{tt}/AP_{tt}$ where $AD_{tt}$ is the absorption due to the dye and $AP_{tt}$ is the absorption due to the polymer for the total thickness of the coating;

and the values for $AD_{sl}$, $AP_{sl}$, $AD_{tt}$ and $AP_{tt}$ being measured by Attenuated Total Reflection Spectroscopy.

11 Claims, No Drawings

THERMAL TRANSFER PRINTING DYE SHEET

This invention relates to a thermal transfer printing (TTP) dye sleet.

Thermal transfer printing is a printing process in which a dye is caused, by thermal stimuli, to transfer from a dye sleet to a receiver street. In such a process, the dye sheet and the receiver sheet are placed in intimate contact, the thermal stimuli are applied to the dye sheet to cause aye transfer and the dye sheet and the receiver sheet are then separated. By applying the thermal stimuli to pre-determined areas in the dye sheet, the dye is selectively transferred to the receiver sheet to form the desired image. The thermal stimuli may be provided by a programmable print head which is in contact with the dye sheet or by a laser in a light induced thermal transfer process (LITT).

Dye sheets conventionally comprise a substrate having on one surface a dye coat, the essential components of which are a binder resin and, dispersed therein a thermally transferable dye. A back coat may be provided on the other surface to impart desireable properties, for example, good handling and thermal characteristics. Further a primer or subbing layer may be employed between the substrate and the dye coat and/or the substrate and the back coat to improve adhesion.

The dye coat is normally applied by coating a homogeneous solution of the dye and the polymer on to the substrate and then rapidly evaporating the solvent. Depending on the coating conditions, the distribution of the low molecular weight dye in the high molecular weight polymer can vary.

During the TTP process, application of a thermal stimulus to an area of the dye sheet heats that area to a temperature typically in excess of 100° C. causing dye from a corresponding area of the dye coat to be transferred to the receiver sheet. However, the whole area of the dye coat is in contact with the receiver sheet and under certain conditions, for example high ambient temperature and/or prolonged use of a printer, the temperature can be sufficiently high to cause unwanted and uncontrolled transfer of dye. This problem, known as low temperature thermal transfer (LT3), is likely to more acute if there is a high concentration of dye at or near the surface of the dye coat, ie within the upper 0.5 μm.

A further problem resulting from a high surface concentration of dye is that control of dye transfer at low levels, ie when reproducing pale shades, is more difficult.

Hence, it would be advantageous if the concentration of dye in the binder could be controlled so that the distribution was more homogeneous.

However, for such control to be possible, it is necessary that a measure of the homogeneity of the distribution of the dye in the polymer can be established.

It has now been found that this can be achieved by using the technique of Attenuated Total Reflection Spectroscopy (ATRS), otherwise known as Internal Reflection Spectroscopy(IRS).

ATRS is an inra-red technique which utilises a material of high refractive index as a guide for a beam of infra-red radiation. At angles above the critical angle, the beam is totally internally reflected within the guide. However, at each point of reflection, an exponentially decaying wave (the evanescent wave) extends for a small distance beyond the confines of the guide and can penetrate and interact with an IR absorbing sample placed against the reflecting surface of the guide and be absorbed at specific wavelengths and absorption spectra produced as in conventional infra-red spectroscopy. The propagating beam within the guide is thus attenuated and the degree of attenuation, which is dependent on the material of the sample, can be measured.

The penetration depth $d_p$, ie the extent to which the evanescent wave penetrates the sample, normally defined as being the depth at which the evanescent wave has decreased to 1/e of its initial value at the interface, is given by the equation.

$$d_p = \frac{\lambda}{2\pi n_1\{\sin^2\phi - [n_2/n_1]^2\}^{1/2}}$$

where $\lambda$ is the wavelength of the IR radiation, $n_2$and $n_1$ are the refractive indices of the guide and the sample, and $\phi$ is the angle of incidencef the radiation on the guide/sample interface.

Thus, in effect, the technique gives a measure of the absorption caused by a layer of the sample whose thickness is equal to $d_p$. $n_1$ and $n_2$ are constant and $\lambda$ is fixed because of the need to choose a value at which there is strong absorbance by the sample, ie at which there will be a peak in the generated spectrum. Hence, $d_p$ is in practice only dependent on the angle of incidence $\phi$, increasing angles giving lower values of $d_p$.

Where the sample is a dye sheet, it is possible, by generating spectra over a range of wavelengths which includes specific wavelengths at which the dye and polymer absorb strongly, to measure the absorption by the dye and the polymer respectively and hence characterise the ratio of dye to polymer within a certain depth of coating. By using appropriate different angles of incidence, this ratio can be measured over a layer adjacent the surface and over the whole thickness of the dye coat and, a measure of the homogeneity of the distribution of the dye in the polymer can be established.

As an alternative to generating spectra, monochromatic ir sources emitting radiation having wavelengths strongly absorbed by the dye and polymer can be used in order to simplify the instrumentation.

Thus, in general terms, at a suitable high angle of incidence (eg 60°), the ratio of dye to polymer over a layer adjacent the surface is given by $$K_{sl}=AD_{sl}/AP_{s1}$$

where $AD_{sl}$ is the absorption due to the dye and $AP_{sl}$ is the adsorption due to the polymer over the surface layer.

Repeating the process at a low angle of incidence (eg 35°) gives $$K_{tt}=AD_{tt}/AP_{tt}$$

where $AD_{tt}$ is the absorption due to the dye and $AP_{tt}$ is the absorption due to the polymer for the total thickness of the coating.

An indication of the homogeneity of the distribution of the dye in the polymer is, therefore, defined by the quantity $$R=K_{sl}/K_{tt}.$$

and hence for optimum homogeneity R−1 should be a minimum.

The different wavelengths used for the absorption by the dye and polymer can produce an error in that the dye/polymer comparison is being made over two layers of differing thicknesses due to the dependence of $d_p$ on the wavelength. This is of little importance when measuring over the total thickness of the coating, but, depending on the wavelength difference, it may be necessary to carry out the surface layer measurements at two different angles in order to equalise $d_{p+}$for the dye and polymer.

For further details of ATR, reference may be made to Handbook of Spectroscopy Vol II pages 37 to 48, edited by J W Robinson and published by CRC Press and Internal Reflection Spectroscopy by N. J. Harnck and published by J Wiley & Sons.

According to one aspect of the invention, there is provided a dye sheet for thermal transfer printing comprising a substrate having on one surface thereof a dye coat consisting of a dye dispersed in a polymer binder, characterised in that R−1 (as hereinbefore defined) is a minimum.

Preferably, the value of R−1 should be less than 0.15, preferably less than 0.1.

As mentioned above, the distribution of the dye in the polymer is effected by the processing conditions during application of the dye layer, in particular the drying conditions.

According to another aspect of the invention, there is provided a method of manufacturing a dye sheet comprising coating a homogeneous solution of a dye and a polymer binder on to a substrate and drying the resulting coating such R−1 (as hereinbefore defined) is a minimum.

Preferably, R−1 has a value of less than 0.15 and more preferably less than 0.1.

Conventionally, dye sheets are manufactured in the form of a continuous ribbon with the dye coat being applied as a series of parallel panels transverse to the longitiudinal axis of the ribbon. ATRS measurement of the homogeneity is particularly useful in such manufacture as by feeding back a signal derived from the measurement, the drying conditions can be altered to give the optimum distribution.

According to a further aspect of the invention, there is provided a method of manufacturing a dye sheet for thermal transfer printing comprising coating a homogeneous solution of a dye and a polymer binder on to a substrate so as to form a series of parallel panels, drying at least one of said panels, measuring the value of R (as hereinbefore defined ) using Attenuated Total Reflection Spectroscopy, generating a control signal dependent on said value of R and and using the conrol signal to alter the drying conditions.

The conditions will depend on the composition of the dye coat, ie the particular dye(s), polymer(s) and solvent(s) used and testing by measurement of a series of samples made under different conditions is necessary to establish the optimum conditions for each combination.

The polymer binder, dye and substrate material must, of course, meet certain criteria so that the ATR technique can be utilised. Thus, the polymer binder and the dye should absorb strongly at different wavelengths so that the spectra generated have distinct differences and the substrate should have minimal absorption at these wavelengths, although instruments for use with the ATR technique can compensate for any such absorption. The ATR technique can, of course, be used to check whether individual components are suitable.

Subject to the above provision, the polymer binder can be selected from such known polymers as polycarbonate, polyvinyl butyral and cellulose polymers such as methyl cellulose, ethyl cellulose and hydroxy ethyl cellulose, for example, and mixtures thereof.

In addition to meeting the above provisision, the dye must also be capable of being thermally transferred in the manner described above. Suitable dyes include azo, anthraquinone, naphthoquinone, azomethine, methine, indoaniline, isothiazole, azopyridone,disazothiophene, quinophthalone and nitro dyes. Particularly preferred dyes are isothiazole, anthraquinone, azopyridone and disazothiazole dyes.

The thickness of the dyecoat is suitably 0.1–5μm, preferably 0.5–3 μm.

The dye and binder are suitably present in the dye-coat in a weight ratio of 0.1 to 3:1 of dye to binder. The relative amounts of dye and binder are suitably selected depending on the particular dye and binder employed and the application for which the dye sheet is to be used.

Preferably, the dye sheet comprises a backcoat disposed on the opposite side of the substrate to the dye-coat to provide suitable heat resistance and slip and handling properties. Suitable backcoats having a desirable balance of properties include those described in EP-A-314348 and especially those described in EP-A-458522. Particularly preferred backcoats include those in which the backcoat comprises the reaction product of radically co-polymerising in a layer of coating composition, the following constituents:

a) at least one organic compound having a plurality of radically polymerisable saturated groups per molecule and b) at least one organic compound having a single radically polymerisable unsaturated group the backcoat also containing an effective amount, as slip agent, of c) a metallic salt of a phosphate ester.

In cases, where the dye sheet is to be used in a LITT process, a separate absorber layer comprising a light absorbing material disposed between the dye-coat and the substrate may be employed. The light-absorbing material suitably comprises a material which is an absorber for the inducing light to convert it into the required thermal energy to effect transfer of the dye.

If present, the absorber is preferably carbon black, as this provides good absorption and conversion to heat, of a broad spectrum of wavelengths, and hence is not critical to the inducing light source employed for the printing, further, it is also releatively cheap.

However, any suitable absorber materials known in the art may be employed as desired. For lasers operating in the near infrared, there are also a number of organic materials known to absorb at the laser wavelengths. Examples of such materials included the substituted phthalocyanines described in EP-B-157,568, which can readily be selected to match laser diode radiation at 750–900 nm, for example.

It is desireable that the evanescent wave has minimal penetration into the absorber layer during measurement of the dye/polymer ratio, although any effect due to such penetration can be compensated for.

A variety of materials can be used for the substrate, including transparent polymer films of polyesters, polyamides, polyimides, polycarbonates, polysulphones, polypropylene and cellophane, for example. Biaxially orientated polyester film is the most preferred, in view of its mechanical strength, dimensional stability and heat resistance. The thickness of the substrate is suitably 1–50 μm, and preferably 2–30 μm.

Various coating methods may be employed to coat the dye-coat onto th substrate, including, for example, roll coating, gravure coating, screen coating and fountain coating.

The dye sheet may be elongated in the form of a ribbon and housed in a cassette for convenience, enabling it to be wound on to expose fresh areas of the dyecoat after each print has been made.

Dyesheets designed for producing multicolour prints have a plurality of panels of different uniform colours, usually three: yellow, magenta and cyan, although the provision of a fourth panel containing a black dye, has also previously been suggested. When supported on a substrate elongated in the form of a ribbon, these different panels are suitably in the form of transverse panels, each the size of the desired print, and arranged in a repeated sequence of the colours employed. During printing, panels of each colour in turn are held against a dye-receptive surface of the receiver sheet, as the two sheets are imagewise selectively irradiated to transfer the dye selectively where required, the first colour being overprinted by each subsequent colour in turn to make up the full colour image.

The invention is illustrated by the following non-limiting examples.

EXAMPLE 1

A dye coat solution containing

| % w/w | | |
|---|---|---|
| magenta M0 dye | 38 | (anthraquinone) |
| magenta M3 dye | 9.5 | (isothiazole) |
| poly(vinyl butyral) | 42 | |
| ethyl cellulose | 10.5 | |

in tetrahydrofuran as solvent was coated on to two samples of 6 μ m polyethylene terephthalate sheet using a direct gravure coating technique. The sheets were dried by air impingement for 2 seconds, Sheet 1 being dried at 110° C. and Sheet 2 being dried at 85° C. In each case the final dye coat had a thickness of approximately 1μm.

Both sheets were submitted to ATR using a KRS5 (thallous bromide/iodide) prism.

Absorbance was measured at a wavelength of 4,5 μm (wavenumber of 2224 cm−1) for the dye and 3.41μm (2940cm−1) for the polymer (strong peaks occurring at these wavelengths) and at angles of incidence of 60° (penetration 0.35μ1m) and 35° (penetration 4.0 μm), The value of R was calculated and Sheet 1 was found to have a value of 1.18 and Sheet 2 a value of 1.06.

The LT3 characteristics of each sheet were tested by feeding a portion of the sheet in register with a standard receiver sheet consisting of a dye receptive layer on a polyethylene terephthalate substrate, through a 2-roll laminator (OZATEC HRL350 hot roll laminator available from Hoesch) at 0.2 m/s. The pressure between the rolls of the laminator was 5 bar. The colour change of the receiver sheet (zero if no dye transfer occurs) was measured using a Minolta colour analyser. The test was carried out at four different temperatures and the results are shown in Table 1.

TABLE 1

| | Colour Change | |
|---|---|---|
| Temp. | Sheet 1 | Sheet 2 |
| 45 | 0.8 | 0.8 |
| 50 | 1.8 | 1.1 |
| 55 | 5.8 | 3.3 |
| 60 | 18.2 | 13.5 |

Samples of the two dyesheets were each brought into contact with a sample of the the receiver sheet and thermal transfer printing was effected by means of a programmable print head supplying heat pulses of 2 to 14 millsecond duration to the back of the dye sheet to provide a gradation in the optical density of the print image. The dye sheet and the receiver sheet were separated after the printing and the reflection optical density of the image on the receiver sheet was measured using a Sakura densitometer, The results are shown in Table 2.

TABLE 2

| | Optical Density | |
|---|---|---|
| Print Level | Sheet 1 | Sheet 2 |
| 8 | 3.19 | 3.28 |
| 7 | 2.59 | 2.57 |
| 6 | 1.95 | 1.97 |
| 5 | 1.46 | 1.45 |
| 4 | 1.01 | 0.97 |
| 3 | 0.70 | 0.66 |
| 2 | 0.47 | 0.42 |
| 1 | 0.28 | 0.23 |

The results show that with a more homogeneous distribution of the dye in the polymer, ie with less dye enrichment at the surface, the rate of optical density build-up is delayed and the low temperature thermal transfer is less.

EXAMPLE 2

Example 1 was repeated using an azopyridone dye (yellow) and a disazothiophene dye (cyan). Similar results were obtained.

We claim:

1. A dye sheet for thermal transfer priming comprising a substrate having on one surface thereof a dye coat which comprises a dye capable of thermal transfer dispersed in a polymer binder, characterized in that R−1 is a minimum where $R=K_{sl}/K_{tt}$, wherein $K_{sl}=AD_{sl}/AP_{sl}$ where $AD_{sl}$ is the absorption due to the dye and $AP_{sl}$ is the absorption due to the polymer over the surface layer;

$K_{tt}=AD_{tt}/AP_{tt}$ where $AD_{tt}$ is the absorption due to the dye and $AP_{tt}$ is the absorption due to the polymer for the total thickness of the coating; and the values for $AD_{sl}$, $AP_{sl}$, $AD_{tt}$ and $AP_{tt}$ being measured by Attenuated Total Reflection Spectroscopy.

2. A dye sheet according to claim 1 in which R=1 has a value of less than 0.15.

3. A dye sheet according to claim 1 in which R=1 has a value of less than 0.1.

4. A dye sheet according to claim 1, 2 or 3, in which the dye coat has a thickness of 0.1 to 5 μm.

5. A dye sheet according to claim 4, in which the dye coat has a thickness of 0.5 to 3 μm.

6. A method of manufacturing a dye sheet for thermal transfer printing comprising coating a homogeneous solution of a dye and a polymer binder on to a substrate and drying the resulting coating at a temperature greater than 85° C. and under conditions such that R−1 is a minimum where $R=K_{sl}/K_{tt}$, wherein $K_{sl}=AD_{sl}/AP_{sl}$ where $AD_{sl}$ is the absorption due to the dye and $AP_{sl}$, is the absorption due to the polymer over the surface layer;

$K_{tt}=AD_{tt}/AP_{tt}$ where $AD_{tt}$ is the absorption due to the dye and $AP_{tt}$ is the absorption due to the polymer for the total thickness of the coating; and the values for $AD_{sl}$, $AP_{sl}$, $AD_{tt}$ and $AP_{tt}$ being measured by Attenuated Total Reflection Spectroscopy.

7. A method according to claim 6, in which the conditions are such that R−1 has a value of less than 0.15.

8. A method according to claim 7, in which the conditions are such that R−1 has a value of less than 0.1.

9. A method of manufacturing a dye sheet for thermal transfer priming comprising coating a homogeneous solution of a dye and a polymer binder on to a substrate so as to form a series of parallel panels, drying at least one of said panels, measuring the value of R, where $R=K_{sl}/K_{tt}$, wherein $K_{sl}=AD_{sl}/AP_{sl}$ where $AD_{sl}$ is the absorption due to the dye and $AP_{sl}$ is the absorption due to the polymer over the surface layer;

$K_{tt}=AD_{tt}/AP_{tt}$ where $AD_{tt}$ is the absorption due to the dye and $AP_{tt}$ is the absorption due to the polymer for the total thickness of the coating;

and the values for $AD_{sl}$, $AP_{sl}$, $AD_{tt}$ and $AP_{tt}$ being measured using Attenuated Total Reflection Spectroscopy, generating a control signal dependent on said value of R and using the control signal to alter the drying conditions.

10. A dye sheet for thermal transfer printing comprising a substrate having on one surface thereof a dye coat which comprises a dye capable of thermal transfer dispersed in a polymer binder, characterized in that the dye coat is applied as a solution of dye and polymer in a solvent and in that the solvent is removed at a temperature greater than 85° C. under conditions such that R−1 is a minimum where $R=K_{sl}/K_{tt}$;

$K_{tt}=AD_{tt}/AP_{tt}$ where $AD_{tt}$ is the absorption due to the dye and $AP_{tt}$ is the absorption due to the polymer for the total thickness of the coating;

and the values for $AD_{sl}$, $AP_{sl}$, $AD_{tt}$ and $AP_{tt}$ being measured by Attenuated Total Reflection Spectroscopy.

11. A method of measuring in a dye sheet for thermal transfer printing comprising a substrate having on one surface thereof a dye coat which comprises a dye capable of thermal transfer dispersed in a polymer binder, the vertical distribution of the dye within the polymer, comprising the steps of:

a) placing the dye sheet in contact with an Attenuated Total Reflection Spectroscopy prism;

b) projecting into the prism at an angle of incidence of 60° first and second beams of ir radiation having respectively wavelengths at which the dye and polymer have strong absorbance characteristics;

c) measuring the degree of attenuation of said beams of radiation;

d) repeating steps(a) to (c) at an angle of incidence of 35°, and e) calculating the value of R−1 where $R=K_{sl}/K_{tt}$, wherein $K_{sl}=AD_{sl}/AP_{sl}$ where $AD_{sl}$ is the absorption due to the dye and $AP_{sl}$ is the absorption due to the polymer over the surface layer, and $K_{tt}=AD_{tt}/AP_{tt}$ where $AD_{tt}$ is the absorption due to the dye and $AP_{tt}$ is the absorption due to the polymer for the total thickness of the coating.

* * * * *

UNITED STATES PATENT AND TRADEMARK OFFICE

CERTIFICATE OF CORRECTION

PATENT NO. : 5,691,273
DATED : November 25, 1997
INVENTOR(S) : SLARK et al.

It is certified that error appears in the above-identified patent and that said Letters Patent is hereby corrected as shown below:

Claim 1, line 1, delete "priming" and replace with

--printing--.

Claims 2 and 3, line 1, delete "R=1" and replace with

--R-1-- .

Claim 9, line 2, delete "priming" and replace with

--printing--.

Signed and Sealed this

Second Day of February, 1999

*Attest:*

*Attesting Officer*

*Acting Commissioner of Patents and Trademarks*